United States Patent [19]

Cukier et al.

[11] Patent Number: 4,654,152

[45] Date of Patent: Mar. 31, 1987

[54] BASE MIX FABRIC SOFTENER

[75] Inventors: Samuel Cukier, Toronto; Irshad A. Khan, Mississauga, both of Canada

[73] Assignee: Domtar Inc., Montreal, Canada

[21] Appl. No.: 785,263

[22] Filed: Oct. 7, 1985

[51] Int. Cl.[4] ..... D06M 11/00

[52] U.S. Cl. ..... 252/8.8; 252/8.75

[58] Field of Search ..... 252/8.75, 8.8

[56] References Cited

U.S. PATENT DOCUMENTS

| | | | |
|---|---|---|---|
| 3,681,241 | 8/1972 | Rudy | 252/8.75 |
| 4,298,480 | 11/1981 | Wixon | 252/8.8 |
| 4,326,971 | 4/1982 | Wixon | 252/8.8 |
| 4,399,044 | 8/1983 | Richmond | 252/8.8 |
| 4,399,045 | 8/1983 | Burns | 252/8.8 |
| 4,411,803 | 10/1983 | Wixon | 252/8.8 |
| 4,439,335 | 3/1984 | Burns | 252/8.8 |
| 4,447,343 | 5/1984 | May et al. | 252/8.8 |
| 4,476,030 | 10/1984 | May et al. | 252/8.8 |
| 4,497,716 | 2/1985 | Tai | 252/8.8 |
| 4,569,800 | 2/1986 | Stanley et al. | 252/8.8 |

*Primary Examiner*—Paul Lieberman
*Assistant Examiner*—Willie J. Thompson

[57] ABSTRACT

A method to make and a base mix fabric softener composition of a concentrate remaining substantially pumpable after transportation and on standing, said concentrate comprising: (a) between 80 to 20% by weight of at least one quaternary ammonium compound having the formula:

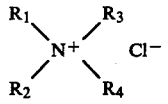

wherein $R_1$ and $R_2$ are each independently selected from the class consisting of alkyl and alkenyl groups having 12 to 20 carbon atoms, and $R_3$ and $R_4$ are each independently selected from the class consisting of $C_1$ to $C_3$ alkyl, $(C_nH_{2n}O)H_x$ where n=2 or 3 and x is from 1 to 3, and (b) between 20 to 80% by weight of at least one alkyl substitute imidazolinium compound having the general formula:

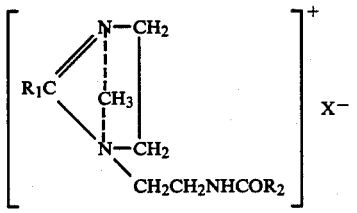

wherein $R_1$ and $R_2$ are each independently selected from the class consisting of alkyl and alkenyl groups having 12 to 20 carbon atoms, and X is $Cl^-$ or $CH_3SO_4$ said concentrate of (a) and (b) being dissolved in a member selected from the class consisting of at least one alcohol, or of a mixture of at least one alcohol and water, said at least one alcohol having a low alkyl chain of 1 to 3 carbon atoms.

5 Claims, No Drawings

BASE MIX FABRIC SOFTENER

This invention relates to a base mix fabric softener, also referred to as fabric conditioner and to a method of making same. More particularly, this invention relates to a pumpable super concentrate base mix which remains pumpable even after transportation or on standing.

BACKGROUND OF THE INVENTION

Fabric conditioning compositions containing 2–20% active ingredients are widely used during laundering. They make the laundered fabrics softer to touch, fluffier and reduce static. The two main classes of product used individually for the above purposes are quaternary ammonium compounds (QAC) or Imidazoline salts. Sometimes even a combination of the two is used at this 2–20% active level ingredients to get optimum results vis-a-vis softening/antistatic cost and freeze/thaw. (The remaining portion being mainly solvents). In order to make such a product, the manufacturer has to prepare the mix from individual concentrates of 75% quaternary ammonium compounds (QAC) and imidazoline salts. This means that the compounder has to keep an inventory of the individual softeners. Also, QAC at conc of 74% or higher have been found so far to crystallize and become hard upon standing, and/or during shipping on long journeys. In other words, when shipped in drums they do become not pumpable.

To make a mixture of the 2 softeners to the usual marketable concentration of 2.5 to 6, it is necessary to make the compound pumpable at the concentration of 75% which sometimes involves heating which can be dangerous and expensive. For both economic reasons (heating involving additional cost), and the reason for safety, heating is a problem.

On the other hand, concentrates, and if feasible, super concentrates, are highly desirable since diluents add to shipping and thereby to the cost of the final product.

THE INVENTION

The present invention aims at producing a pumpable base mix fabric softener composition; such a base mix generally remaining stable, i.e. it remains substantially homogenous and pumpable.

The invention comprises manufacturing a base mix fabric softener composition of a concentrate comprising:

(a) between 80 to 20% by weight of at least one quaternary ammonium compound having the formula

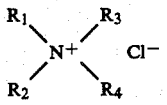

wherein $R_1$ and $R_2$ are each independently selected from the class consisting of alkyl and alkenyl groups having 12 to 20 carbon atoms, and $R_3$ and $R_4$ are each independently selected from the class consisting of $C_1$ to $C_3$ alkyl, $(C_n—H_{2n}O)_xH$, where n is an integer selected from 2 and 3 and x is an integer from 2 to 3, and (b) between 20 to 80% by weight of at least one alkyl quaternized imidazolinium compound having the general formula:

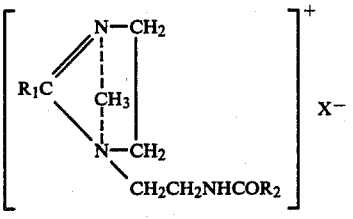

(hereinafter referred to as formula A), wherein for said alkyl substituted imidazolinium $R_1$ and $R_2$ are each independently selected from the class consisting of alkyl and alkenyl groups having 12 to 20 carbon atoms and where X is a member selected from the class consisting of $Cl^-$ and $CH_3SO_4^-$.

Said concentrate of (a) and (b) being dissolved in a member selected from the class consisting of at least one alcohol, or of a mixture of at least one alcohol and water, said at least one alcohol having a low alkyl chain of 1 to 3 carbon atoms.

Alkyl having 16 to 18 carbon atoms are generally the most preferred groups of $R_1$ and $R_2$ for the making of the quaternary ammonium compound, as well as the making of imidazolinium compound.

The solvent may be any low molecular weight alcohol or alcohols and mixture thereof with water, and preferably isopropanol. The isopropanol is generally at least ⅓ to ½ of the solvent depending upon the concentration and the nature of (a) and (b). The most preferred solvent, at the 74–75 active level being most preferably diluted with 5–12.5% water and 20 to 5% isopropanol. Pumpable super concentrate containing at least 60% and preferably 75% active ingredients may be obtained, even 80%, which are pumpable over a range of temperature to about 12° C. When frozen the concentrate is revertible, recovering its pumpability when exposed to above freezing temperatures.

Other ingredients may also be present as is well known to those skilled in the art, such as fragrance, dyes, etc. The ratio of the quaternized imidazolinium to the quaternary ammonium compounds may range widely, according to the desired final product but would normally be used over the range of 80:20 and 20:80.

There are many ways of preparing that base mix: In a particular embodiment of the present invention one consists in preparing a base mix fabric composition of a concentrate comprising:

(a) mixing: between 80 to 20% by weight of at least one trialkyl amine and 20 to 80% by weight of at least an imidazoline derived from fatty acids or tallow and diethylene triamine, to form a blend of amines, (b) reacting under pressure, said blend of amines from step (a) in the presence of chloromethane to quaternize the amines into imidazolinium compounds and quaternary ammonium compounds.

The said method generally yields a more homogeneous product than the combination of the imidazolinium compound or compounds with the quaternary ammonium compound or compounds. It was also found that we can exercise better control in the use of solvents pertaining to individual constituents of the combination which each independently requires more solvents and higher dilution for their respective individual solubility.

Another method consists in mechanically mixing alkyl substituted imidazolinium compounds and solvents as shown in Example 1. The imidazolines may be obtained from tallow or fatty acids and amines, for instance, diethylene triamine to produce amido amines which when submitted under the effect temperature and vacuum produces a compound having the general formula:

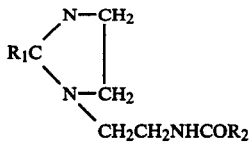

The following will serve to illustrate some of the preferred ways of carrying out the invention.

EXAMPLE 1

A blend was prepared by melting 50% Cedequat IC-75 a trademark for a quaternized imidazolinium chloride dissolved in isopropanol, and mixing it with 50% by weight of distearyldimethylammonium chloride dissolved in isopropanol (DDAC). The DDAC being sold under the trademark "Cedequat" TD-75. It was found that the mixture required much less energy for mixing, when compared against mixing "DDAC" alone.

Samples were taken and stored for 8 weeks at room temperature and at temperatures of 100° and 120° F. After 8 weeks the samples were examined and they all show no phase separation, thereby indicating the product's stability.

EXAMPLES 2 and 3

Two blends of 80% distearyldimethyl ammonium chloride dissolved in aqueous isopropanol and 20% of a mixture also dissolved in aqueous isopropanol of imidazolinium chloride and imidazolinium methosulphate (also known as imidazolinium methylsulphate) having the general formula "A" as referred to on page 3, wherein $R_1$ and $R_2$ are each independently selected from the class consisting of straight tallow chain having a range of 16 to 20 carbon atoms and average of 18 carbon atoms were made dissolved in aqueous isopropanol to obtain the composition as indicated in Table 1.

TABLE 1

| Composition | CEDEQUAT TD-75 P.A. DDAC | CEDEQUAT TD-75 IMIDAZOLIUM CHLORIDE Example 2 The 1st formula | CEDEQUAT TD-75 IMIDAZOLIUM METHYLSULPHATE Example 3 The 2nd formula |
|---|---|---|---|
| % Active | 75.20 | 75.60 | 74.70 |
| % Isopropyl alcohol | 16.02 | 16.14 | 16.23 |
| % water | 7.30 | 7.0 | 7.10 |
| pH of 4.5% active emulsion | 4 | 4 | 4.6 |

These blends were compared against distearyl dimethyl ammonium chloride (DDAC) (called Sample A). The results obtained are shown in Table 2:

TABLE 2

| Stability | Sample A | Example 2 | Example 3 |
|---|---|---|---|
| (a) Appearance at 45°C. | clear light yellow liquid | clear liquid greenish yellow liquid | clear light greenish liquid |
| (b) Appearance at 25° C. after 24 hours | light yellowish :white paste with round granular crystals throughout the mass | opaque light greenish white paste no separation of phases | opaque light greenish white paste no separation of phases |
| (c) Pumpability at 25° C. after 1–2 weeks | unpumpable hard wax | pumpable soft wax | pumpable softer wax |

EXAMPLE 4

This example illustrates the co-quaternization of precursors of quaternary ammonium compound (a ditallow monomethylamine and a substituted imidazoline compounds.

In a kettle, the tertiary amine (T.A.) sold under the trademark "Adogen", (a hydrogenated ditallow monomethylamine having the formula

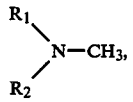

wherein $R_1$ and $R_2$ are hydrogenated tallow groups) and a substituted imidazoline of the formula:

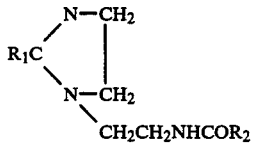

treated in mole ratio of (1:1) in presence of a compatible solvent such as isopropanol. $R_1$ and $R_2$ are mixtures of long chain fatty acid alkyl or alkenyl groups having predominently 16 to 20 carbon atoms.

The kettle is closed and methylchloride fed under 50–80 psi at a temperature of 90° to 110° C. When the pH reached 4–4.5, and the amines were less than 2.5%, the reaction was stopped (less than 6 hours). Bleaching of the resulting mixture was accomplished with $H_2O_2$ (50%) in the presence of a chelating agent. The following results were obtained (Example 4a) and compared against similar base mix whose components had been quaternized before mixing (Example 4b).

| Example Column | Base Mix Production: By coquaternized in situ 4a | Base Mix Production: From individual quaternaries 4b |
|---|---|---|
| Appearance 25° | creamy white paste | |

-continued

| Example Column | Base Mix Production: By coquaternized in situ 4a | Base Mix Production: From individual quaternaries 4b |
|---|---|---|
| % cationic (590) | 75 | 75 |
| % free amine (538.6) | 2 | 2 |
| Colour Gardner max. | 2–3 | 2–3 |
| pH of 5% soln. | 3.7 | 4.3 |
| Pumpability at 20–25° C. | pumpable | pumpable |

As can be easily seen from the above table, no difference could be ascertained between a base mix whose amines have been quaternized in situ and base mix made by blending the quaternary ammmonium compound with the substituted imidazolinium compound.

It was found that best pumpability when 7–5% water is present, lower amount although improving pumpability was increasing the risk of phase separation.

EXAMPLE 5

The same as in Example 1 was followed except that the ratio of 80% to 20% was varied in numerous samples up to ratios of 20%–80%. It was found that within these ratios, the quaternary ammonium compounds, as well as the imidazolinium compounds were compatible and pumpable at normal temperature, or revertible to pumpable mix when the samples were submitted to freezing periods and brought back to ambient temperatures thereby this representing a substantial advance over the prior art. In all cases, it was also found that the chlorine ions renders the mix much more compatible than when methylsulphate is present.

It can be easily seen to a person skilled in the art that modifications can be made of the above invention, which will be within the scope of the appended claims.

We claim:

1. A base mix fabric softener composition of a concentrate remaining substantially pumpable after transportation and on standing, said concentrate comprising:

(a) between 80 to 20% by weight of at least one quaternary ammonium compound having the formula:

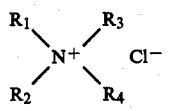

wherein $R_1$ and $R_2$ are each independently selected from the class consisting of alkyl and alkanyl groups having 12 to 20 carbon atoms, and $R_3$ and $R_4$ are each independently selected from the class consisting of $C_1$ to $C_3$ alkyl, $(C_n—H_{2n}O)H_x$, where n is an integer selected from 2 and 3 and x is an integer selected from 1, 2 and 3

(b) between 20 to 80% by weight of at least one alkyl substitute imidazolinium compound having the general formula:

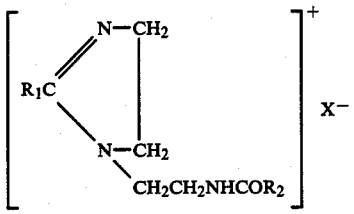

wherein $R_1$ and $R_2$ are each independently selected from the class consisting of alkyl and alkenyl groups having 12 to 20 carbon atoms and where $X^-$ is a member selected from the class consisting of the ion chloride, and the ion methyl sulfate, said concentrate of (a) and (b) being dissolved in a member selected from the class consisting of at least one alcohol, or of a mixture of at least one alcohol and water, said at least one alcohol having a low alkyl chain of 1 to 3 carbon atoms, and wherein said (a) and (b) represent between 60 to 80% by weight, based upon the total weight of the base mix, thereby producing a super concentrate.

2. The base mix as defined in claim 1 wherein said $R_1$ and $R_2$ as defined in paragraph (a) for the quaternary ammonium compound, and as defined in paragraph (b) imidazolinium compound are each independently selected from alkyl and alkenyl groups having between 16 and 20 carbon atoms and having an average value of 18 carbon atoms.

3. The base mix as defined in claim 1, wherein said diluent is isopropanol and water, said isopropanol is at least ⅓ to ½ by weight of said diluent.

4. The base mix as defined in claim 1, wherein said (a) and (b) represent at least 74%, said diluent is isopropanol end water, said isopropanol is at least 20 to 5%, said water is about 5 to 12.5% and said, % being by weight based upon the total weight of the base mix, thereby producing a super concentrate.

5. A method of preparing a base mix fabric composition of a concentrate as defined in claim 1 comprising:

(a) mixing: between 80 to 20% by weight of at least one dialkyl amine and 20 to 80% by weight of at least an imidazoline derived from fatty acids and diethylene triamine, to form a blend of amines, (b) reacting under pressure, said blend of amines from step (a) in the presence of chloromethane and a mixture of alcohol and water, said alcohol having a low alkyl chain of 1 to 3 carbon atoms to quaternize the amines into at least one imidazolinium compound and at least one quaternary ammonium compounds.

* * * * *

UNITED STATES PATENT AND TRADEMARK OFFICE

CERTIFICATE OF CORRECTION

PATENT NO. : 4,654,152

DATED : March 31, 1987

INVENTOR(S) : Samuel Cukier & Irshad A. Khan

It is certified that error appears in the above-identified patent and that said Letters Patent is hereby corrected as shown below:

In claim 1, column 6, line 6 to 16, the formula should appear as follows:

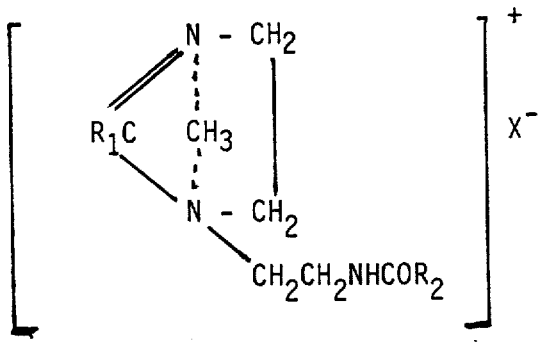

Signed and Sealed this

Twenty-sixth Day of April, 1988

*Attest:*

DONALD J. QUIGG

*Attesting Officer*

*Commissioner of Patents and Trademarks*